US008837972B2

(12) United States Patent
Nakade

(10) Patent No.: US 8,837,972 B2
(45) Date of Patent: Sep. 16, 2014

(54) IMAGE FORMING APPARATUS THAT REMOVES RESIDUAL TONER ON IMAGE BEARING BODY WITH CLEANING BLADE

(75) Inventor: Yohei Nakade, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 206 days.

(21) Appl. No.: 13/561,512

(22) Filed: Jul. 30, 2012

(65) Prior Publication Data

US 2013/0034365 A1 Feb. 7, 2013

(30) Foreign Application Priority Data

Aug. 2, 2011 (JP) ..... 2011-169289

(51) Int. Cl.
*G03G 15/00* (2006.01)
*G03G 15/16* (2006.01)

(52) U.S. Cl.
CPC ..... *G03G 15/5062* (2013.01); *G03G 15/5054* (2013.01); *G03G 15/00* (2013.01)
USPC ..... 399/72; 399/66; 399/49; 399/343

(58) Field of Classification Search
CPC ..... G03G 15/5062; G03G 15/5054; G03G 15/00; G03G 15/2215; G03G 15/0164
USPC ..... 399/66, 72, 49, 343
See application file for complete search history.

(56) References Cited

U.S. PATENT DOCUMENTS

2010/0080602 A1 4/2010 Taguma
2011/0222885 A1* 9/2011 Yamaki et al. ..... 399/66

FOREIGN PATENT DOCUMENTS

JP 2000-019920 A 1/2000
JP 2000-112298 A 4/2000
JP 2001-5237 A 1/2001
JP 2001-324841 A 11/2001
JP 2001-324896 A 11/2001
JP 2003-263071 A 9/2003

(Continued)

OTHER PUBLICATIONS

Office Action (Notice of Grounds of Rejection) issued on Oct. 15, 2013, by the Japanese Patent Office in corresponding Japanese Patent Application No. 2011-169289, and an English Translation of the Office Action. (8 pages).

(Continued)

*Primary Examiner* — David Gray
*Assistant Examiner* — Michael Harrison
(74) *Attorney, Agent, or Firm* — Buchanan Ingersoll & Rooney PC

(57) ABSTRACT

An image forming apparatus includes an image bearing body, a latent image forming section that forms a latent image on the image bearing body, a development section that develops the latent image using toner, a transfer section that transfers a toner image to a transferred body, a pressuring and contacting section that pressures and contact the transfer section against and with the image bearing body via the transferred body, a cleaning blade that removes residual toner, and a controller. The controller analyzes a print pattern of the image to be formed on the sheet. The controller controls the pressuring and contacting section to change a contact state between the image bearing body and the transferred body while adjusting an image patch formed in a domain corresponding to an inter-sheet portion between the sheet and the next sheet on the image bearing body according to an analysis result.

9 Claims, 9 Drawing Sheets

(56) References Cited

FOREIGN PATENT DOCUMENTS

| | | | |
|---|---|---|---|
| JP | 2004-93770 | A | 3/2004 |
| JP | 2005-164722 | A | 6/2005 |
| JP | 2006-139111 | A | 6/2006 |
| JP | 2006-251138 | A | 9/2006 |
| JP | 2008-180790 | A | 8/2008 |
| JP | 2008-225240 | A | 9/2008 |
| JP | 2009-53396 | A | 3/2009 |
| JP | 2010-079019 | A | 4/2010 |
| JP | 2011-27931 | A | 2/2011 |

OTHER PUBLICATIONS

Office Action (Notice of Reasons of Refusal) issued on Feb. 4, 2014, by the Japan Patent Office in corresponding Japanese Patent Application No. 2011-169289, and an English Translation of the Office Action. (7 pages).

* cited by examiner

FIG.12

| | CONDITION | | | EVALUATION (AFTER 100K PRINTS) | | |
|---|---|---|---|---|---|---|
| | IMAGE DETERMINATION AND VARIABLE PATCH AMOUNT | VARIABLE PRIMARY TRANSFER BIAS | VARIABLE PRIMARY TRANSFER PRESSURE | IMAGE NOISE | TONER CONSUMPTION AMOUNT | RESULT |
| EXAMPLE 1 | YES | YES | YES | VERY GOOD | GOOD | VERY GOOD |
| EXAMPLE 2 | YES | YES | NO | GOOD | GOOD | GOOD |
| EXAMPLE 3 | YES | NO | YES | AVERAGE | GOOD | AVERAGE |
| REFERENCE EXAMPLE 4 | NO | YES | YES | VERY GOOD | BAD | BAD |

IMAGE FORMING APPARATUS THAT REMOVES RESIDUAL TONER ON IMAGE BEARING BODY WITH CLEANING BLADE

This application is based on Japanese Patent Application No. 2011-169289 filed with the Japan Patent Office on Aug. 2, 2011, the entire content of which is hereby incorporated by reference.

BACKGROUND OF THE INVENTION

1. Field of the Invention

The present invention relates to an image forming apparatus and, particularly to an image forming apparatus that forms an image by an electrophotographic system.

2. Description of the Related Art

In an electrophotographic image forming apparatus (such as an MFP (Multi Function Peripheral) including a scanner function, a facsimile function, a copying function, a function as a printer, a data communication function, and a server function, a facsimile device, a copying machine, and a printer), it is necessary to keep a component used in an imaging unit in good condition in order to maintain good print quality for a long period of time. Therefore, a cleaning device is attached to a photosensitive body (image bearing body) that largely affects the image quality. The cleaning device includes a rubber blade that contacts with a surface of the photosensitive body to remove toner, which is not transferred, from the surface of the photosensitive body.

As to the cleaning device, it is well known that chatter or peeling of the cleaning blade occurs depending on an amount of toner or external additive, which is accumulated between the photosensitive body and the cleaning blade, and that performance of the cleaning blade largely depends on the chatter or peeling of the cleaning blade. In order to effectively operate the cleaning device to keep the surface of the photosensitive body in good condition, it is necessary to maintain the amount of toner or external additive accumulated between the photosensitive body and the cleaning blade at a constant value.

The amount of toner or external additive accumulated between the photosensitive body and the cleaning blade depends on an amount of residual toner or a charging state of the residual toner on the photosensitive body. In other words, in the state in which the image forming apparatus is actually used, the amount of toner or external additive always changes according to type (such as a kind of the image and a coverage rate) of the image printed by a user. For example, when the image having the low coverage rate is repeatedly printed, a small amount of toner is supplied to the cleaning device.

When the amount of toner supplied to the cleaning device is decreased, the performance of the cleaning device is tentatively degraded. Therefore, when the print is performed after the image having the low coverage rate is repeatedly printed, the residual toner is insufficiently cleaned, and sometimes an image fault is generated. The image fault is significantly generated particularly when the image having the high coverage rate is printed.

Conventionally, in order to solve the problem, it is well known that the toner is forcedly consumed to supply the toner to the cleaning device when the low-coverage-rate image is printed. The toner can be supplied to the cleaning device by forming an image patch in a non-print domain, such as an inter-sheet portion.

For example, Document 1 discloses that, in an image forming apparatus, the toner in a development device is recovered by the cleaning device through a photosensitive drum in each 2000 sheets of the images. The operation is performed to prevent a problem caused by the degradation of the toner in the development device. In the image forming apparatus disclosed in Document 1, a developer discharge mode is performed when an average image rate is equal to or lower than a given value.

In view of the problem, Document 2 discloses that, in an image forming apparatus including the cleaning blade, the image patch is formed on the image bearing body during an idling state of the image bearing body and an application of a primary transfer voltage is stopped.

Document 3 discloses that, in an image forming apparatus, density of the specific image patch formed on the photosensitive drum is measured with a density sensor to control the density of the image formed on the sheet. In the image forming apparatus disclosed in Document 3, an intermediate transfer belt is separated from the photosensitive drum during the formation of the image patch, which allows the density of the image patch to be properly measured on the photosensitive drum.

[Document 1] Japanese Patent Laying-Open No. 2011-027931

[Document 2] Japanese Patent Laying-Open No. 2004-093770

[Document 3] Japanese Patent Laying-Open No. 2001-005237

However, in the conventional image forming apparatuses, the toner is consumed more than necessary, the number of images that can be printed for a certain unit amount of toner (for example, for one toner cartridge) is lower than the originally-expected number of images.

For example, when the developer discharge mode is performed in the image forming apparatus disclosed in Document 1, the image patch having a given size is formed in each 2000 sheets. In this case, when the image having the relatively high coverage rate is formed in the latest image formation even if the average image rate (coverage rate) is lower than a given value, the originally unnecessary patch is formed although a relatively sufficient amount of toner is supplied to the cleaning device, and therefore the toner is uselessly consumed. On the other hand, because the patch is formed at the low frequency of every 2000 sheets even if the images having the considerably low coverage rates are successively formed, a lack of toner supplied to the cleaning device is generated, and possibly the image is improperly formed.

In the image forming apparatus disclosed in Document 2, because the image patch is substantially always formed during the idling state of the image bearing body, the consumption amount of the toner that is not used to form the image is increased, and the above problem cannot be solved.

Document 3 does not disclose at all the effective measure to solve the above problem.

The present invention is devised to solve the problem, and an object of the present invention is to provide an image forming apparatus, an image forming apparatus controlling method, and a control program for the image forming apparatus, in which the toner consumption amount is decreased and the chatter or peeling of the cleaning blade can be prevented to maintain the state in which the image is properly formed.

SUMMARY OF THE INVENTION

In order to achieve the object, according to an aspect of the present invention, there is provided an image forming apparatus that forms an image on a sheet by an electrophotographic system, the image forming apparatus including: an image bearing body for rotating in a given direction; a latent image forming section for forming a latent image on the image bearing body; a development section for developing the latent image using toner to form a toner image on the image bearing body; a transfer section for transferring the toner image to a transferred body; a pressuring and contacting section for pressuring and contacting the transfer section against and with the image bearing body via the transferred body; a cleaning blade contacting with the image bearing body, the cleaning blade being disposed to remove residual toner remaining on the image bearing body after the toner image is transferred to the transferred body by the transfer section; and a controller for controlling each section of the image forming apparatus, wherein the controller includes: an analyzer for analyzing a print pattern of the image to be formed on the sheet; and an adjuster for controlling the pressuring and contacting section to change a contact state between the image bearing body and the transferred body while adjusting an image patch formed in a domain corresponding to an inter-sheet portion between the sheet and the next sheet on the image bearing body according to an analysis result of the analyzer.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 12 is a table illustrating an evaluation result of an operation of the image forming apparatus of the embodiment.

DESCRIPTION OF THE PREFERRED EMBODIMENTS

Hereinafter, an image forming apparatus according to an embodiment of the present invention will be described.

[Entire Configuration of Image Forming Apparatus]

Figure 1:
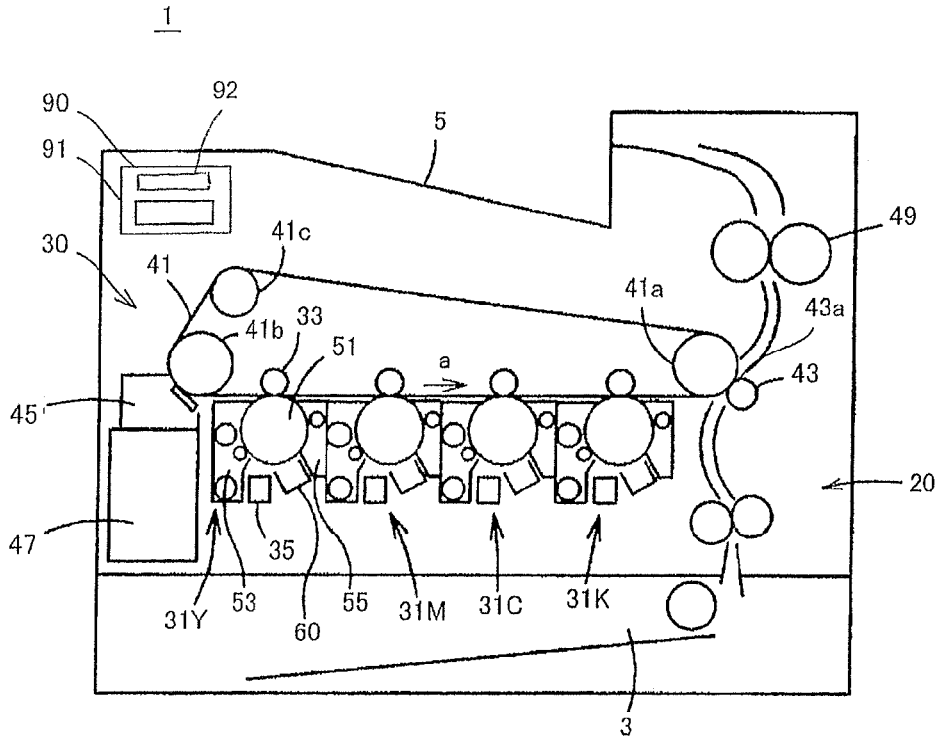
FIG. 1 is a side view illustrating an image forming apparatus according to an embodiment of the present invention.

FIG. 1 is a side view illustrating an image forming apparatus 1 according to an embodiment of the present invention.

Referring to FIG. 1, image forming apparatus 1 includes a sheet feed cassette 3 and a discharge tray 5. A sheet conveying section 20, an image forming section 30, a controller (an example of the controller) 90, and the like are formed in a chassis of image forming apparatus 1.

B5-size, A4-size, and A3-size sheets are loaded on sheet feed cassette 3. Sheet feed cassette 3 is disposed in a lower portion of image forming apparatus 1 while being able to be inserted in and removed from the chassis of image forming apparatus 1. During the print, the sheets loaded on sheet feed cassette 3 are fed from the sheet feed cassette 3 one by one, and conveyed to image forming section 30. The number of sheet feed cassettes 3 is not limited to one, but at least two sheet feed cassettes 3 may be provided.

Discharge tray 5 is disposed on the top of image forming apparatus 1. The sheet on which an image is formed by image forming section 30 is discharged to discharge tray 5 from the inside of the chassis of image forming apparatus 1.

Sheet conveying section 20 includes a sheet feed roller, a registration roller, a discharge roller, and a motor that drives the rollers. For example, while the sheet is nipped between the two rollers facing each other, the rollers are rotated by a driving force of the motor to convey the sheet.

The sheet is fed from sheet feed cassette 3 by sheet conveying section 20, and a skew of the sheet is corrected by the registration roller. Then the sheet is conveyed to image forming section 30. The sheet is conveyed from a fixing device 49 by sheet conveying section 20, and discharged to the outside of the chassis of image forming apparatus 1. The discharged sheet is stacked on discharge tray 5.

Image forming section 30 includes four sets of printheads 31Y, 31M, 31C, and 31K (hereinafter, sometimes referred to as printheads 31 without distinguishing printheads 31Y, 31M, 31C, and 31K from one another), four sets of light beam scanning devices (an example of the latent image forming section) 35, an intermediate transfer belt 41, a secondary transfer roller 43, and fixing device 49. Image forming section 30 is configured to be able to form a color image on the sheet by the electrophotographic system.

Circular intermediate transfer belt 41 is entrained about support rollers 41*a* and 41*b* and a tension roller 41*c*. Intermediate transfer belt 41 rotates in a direction of an arrow a such that support rollers 41*a* and 41*b* rotate in conjunction with sheet conveying section 20. Secondary transfer roller 43 is disposed opposite a portion that contacts with support roller 41*a* of intermediate transfer belt 41. In a transfer section 43*a* between intermediate transfer belt 41 and secondary transfer roller 43, the sheet is conveyed with nipped between intermediate transfer belt 41 and secondary transfer roller 43.

Each printhead 31 includes a photosensitive body (an example of the image bearing body) 51, a development device (an example of the development section) 53, a cleaner 55, and a charging device 60. Printheads 31C, 31M, 31Y, and 31K are provided to form CMYK images of cyan (C), magenta (M), yellow (Y), and black (K), respectively. Each printhead 31 is disposed immediately below intermediate transfer belt 41. The four sets of printheads 31 are disposed such that printhead 31Y corresponding to yellow (Y), printhead 31M corresponding to magenta (M), printhead 31C corresponding to cyan (C), and printhead 31K corresponding to black (K) are sequentially arrayed from an upstream side to a downstream side in a rotating direction of intermediate transfer belt 41 (In FIG. 1, from the left to the right). A primary transfer roller (an example of the transfer section) 33 is disposed above photosensitive body 51 such that intermediate transfer belt 41 is nipped therebetween.

Light beam scanning device 35 is disposed below each printhead 31. Light beam scanning device 35 scans photosensitive body 51 of each printhead 31 with a laser beam. Note that a unitized light beam scanning device corresponding to printhead 31 each may be used.

A cleaning device 45 that removes a residual toner on intermediate transfer belt 41 and a waste toner recovery box 47 are disposed in a lateral portion of intermediate transfer belt 41. The toner removed from photosensitive body 51 with of cleaner 55 of printhead 31 is recovered into waste toner recovery box 47 through a conveying route (not illustrated).

Fixing device 49 includes a heating roller and a pressurizing roller. In fixing device 49, the sheet on which the toner image is formed is conveyed with nipped between the heating roller and the pressurizing roller, and the sheet is heated and pressurized. Therefore, fixing device 49 melts the toner adhering to the sheet, and fixes the toner to the sheet to form the image. The sheet passing through fixing device 49 is discharged from the chassis of image forming apparatus 1 by the discharge roller.

For example, controller 90 includes a CPU, an adjuster 92 and a working memory. A control program 91 is stored in controller 90. Based on control program 91, controller 90 controls operations of the sections, such as sheet conveying section 20 and image forming section 30, of image forming apparatus 1. Therefore, as described later, image forming apparatus 1 forms the image.

Figure 2:
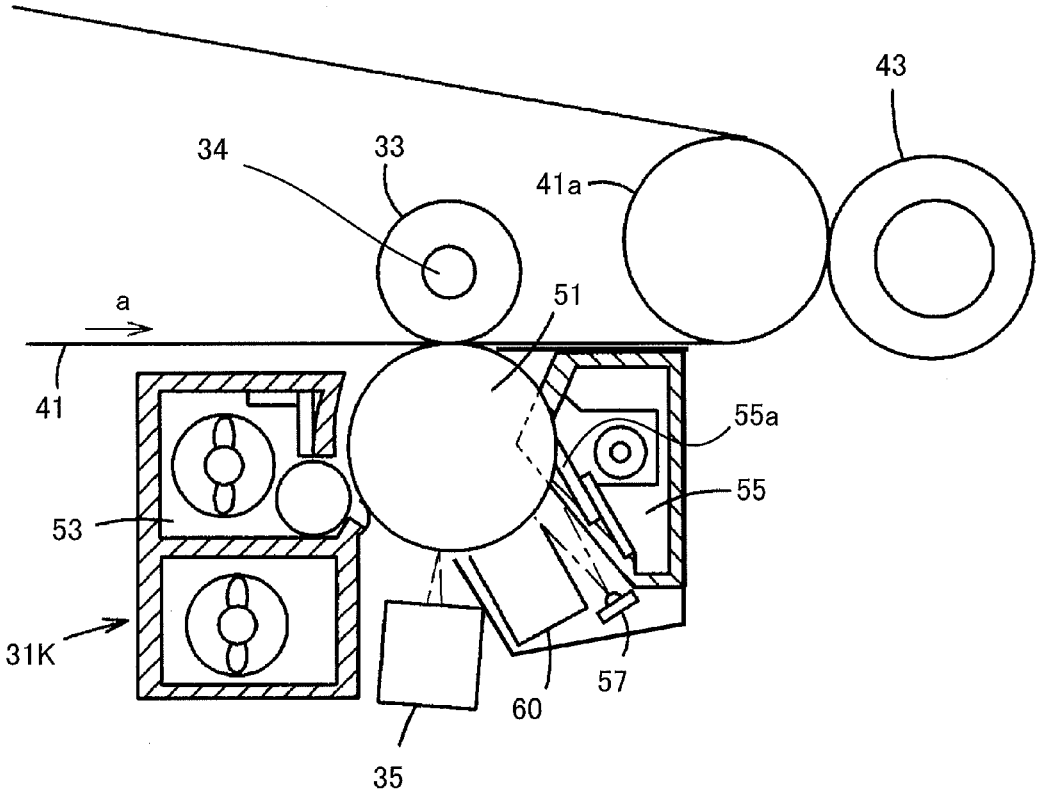
FIG. 2 is a side view illustrating a printhead.

FIG. 2 is a side view illustrating printhead 31K.

In FIG. 2, only printhead 31K corresponding to black (K) is illustrated in printheads 31Y to 31K. Other printheads 31Y, 31M, and 31C have the same configuration as printhead 31K.

As illustrated in FIG. 2, photosensitive body 51 has a drum shape to rotate in a given direction. Photosensitive body 51 is disposed such that a direction (main scanning direction) orthogonal to the rotating direction of intermediate transfer belt 41, which is indicated by arrow a, is a longitudinal direction. Development device 53 is provided on a downstream side of a region in which light beam scanning device 35 scans photosensitive body 51 with the laser beam. Each piece of color toner is stored in development device 53 of each printhead 31. Development device 53 contacts with photosensitive body 51 while agitating the toner therein, and development device 53 causes the toner evenly adhere to a surface of the development roller that rotates together with photosensitive body 51.

Cleaner 55 is disposed on the downstream side in the rotating direction of a region in which photosensitive body 51 contacts with intermediate transfer belt 41. Cleaner 55 includes a cleaning blade 55*a* in which a leading end portion contacts with the surface of photosensitive body 51. After the toner image is transferred to intermediate transfer belt 41 with the rotation of photosensitive body 51, cleaner 55 scrapes the toner remaining on the surface of photosensitive body 51 with cleaning blade 55*a*, and removes the toner from the surface of photosensitive body 51. Cleaner 55 sends the removed toner to waste toner recovery box 47.

An eraser 57 is provided on the downstream side of cleaner 55 in the rotating direction of photosensitive body 51. Eraser 57 irradiates the surface of photosensitive body 51 with light to erase a charge remaining on the surface of photosensitive body 51.

Charging device 60 evenly charges the surface of photosensitive body 51, in which the charge is erased by eraser 57.

A transfer bias (transfer voltage) is applied to primary transfer roller 33 from a power supply. Primary transfer roller 33 is disposed such that intermediate transfer belt 41 is nipped between photosensitive body 51 and primary transfer roller 33. The toner image formed on photosensitive body 51 is transferred onto intermediate transfer belt 41 serving as the transferred body, by properly applying the transfer bias to primary transfer roller 33.

A pressuring and contacting mechanism (an example of the pressuring and contacting section) 34 is provided in primary transfer roller 33. For example, pressuring and contacting mechanism 34 is driven under the control of controller 90, for example. Therefore, pressuring and contacting mechanism 34 presses and contacts primary transfer roller 33 on photosensitive body 51 with intermediate transfer belt 41 interposed therebetween, or separates primary transfer roller 33 from intermediate transfer belt 41. Pressuring and contacting mechanism 34 weakens a pressuring and contacting force to photosensitive body 51 without separating primary transfer roller 33 from intermediate transfer belt 41. In other words, pressuring and contacting mechanism 34 changes a pressuring and contacting state between intermediate transfer belt 41 and photosensitive body 51 by changing the pressuring and contacting force of primary transfer roller 33. For example, pressuring and contacting mechanism 34 is driven to change the pressuring and contacting force of primary transfer roller 33 during patch formation which will be described later.

Image forming section 30 performs the image formation (print) as follows. That is, light beam scanning device 35 forms a latent image on each photosensitive body 51 that is evenly charged by charging device 60. The latent image is formed based on image data of each of CMYK colors of the image to be printed. Development device 53 develops the latent image on photosensitive body 51 using the toner, and forms the toner image of each color on photosensitive body 51. Primary transfer roller 33 transfers the toner image formed on each photosensitive body 51 to intermediate transfer belt 41, and primary transfer roller 33 forms a mirror image of the toner image, which is formed on the sheet, on intermediate transfer belt 41 (primary transfer). Yellow, magenta, cyan, and black toner images are sequentially formed on intermediate transfer belt 41. That is, the color image is formed on intermediate transfer belt 41. Then, in transfer section 43*a*, secondary transfer roller 43 transfers the toner images formed on the intermediate transfer belt 41 to the sheet to form the toner images on the sheet (secondary transfer). The sheet on which the toner image is formed is sent to fixing device 49. The toner is fixed by fixing device 49 to form the image on the sheet. Then the sheet is discharged from image forming apparatus 1 to discharge tray 5.

[Description of Patch Forming Operation]

At this point, image forming apparatus 1 is configured to perform a patch forming operation to form an image patch in a domain (non-print portion; hereinafter sometimes referred to as an inter-sheet domain) corresponding to a gap between the sheet and the next sheet on photosensitive body 51 in each printhead 31. For example, the adiuster 92 in the controller 90 analyzes a print pattern of the image formed on the sheet, and performs the patch forming operation in each color according to its analysis result. In the patch forming operation, the adiuster 92 adjusts the formed image patch according to the image formed on the sheet. In other words, the adiuster 92 adjusts whether the image patch is formed. In forming the image patch, the adiuster 92 adjusts an area or density of the image patch.

In the embodiment, an analysis target is aimed at a coverage rate of the image as the print pattern of the image. That is, for a low coverage rate of the image formed on the sheet, the image patch is formed in the inter-sheet domain. At this point, an image patch amount (such as the area and the density) is adjusted according to the coverage rate.

As used herein, the coverage rate (sometimes referred to as a coverage) means a rate of a print domain to which the toner adheres to a surface area of the sheet (for example, the domain in which the image may be formed in the sheet). For example, in the following case, it is said that the coverage rate is relatively low (low coverage). That is, examples of the low coverage include the case that a small number of characters exist in the image formed on the sheet while other domains are blank, the case that the solid image (the image having the filled domain) having the small area is disposed only in a part of the sheet while other domains are blank, and the case that only the print domain having the low density is disposed. On the other hand, it is said that the coverage rate is relatively high (high coverage) in the case that a large number of characters exist in the image formed on the sheet, the case that the solid image having the relatively large area is disposed, and the case that the print domain having the high density is disposed.

In each printhead 31, by performing the patch forming operation, the toner supplied to cleaner 55 is adjusted, and a cleaning effect of photosensitive body 51 by cleaning blade 55*a* is properly obtained.

In the embodiment, when the patch forming operation is performed, controller 90 changes the pressuring and contacting force (transfer pressure) of the primary transfer roller 33 or the transfer bias according to the coverage rate. In other words, when the image patch is formed, at the time the domain transferred by the primary transfer roller 33 becomes the inter-sheet domain, the transfer pressure of primary transfer roller 33 is weakened (for example, primary transfer roller 33 is separated from intermediate transfer belt 41), and the transfer bias is weakened (for example, the transfer bias is set to zero). The transfer pressure or the transfer bias is changed such that almost all of the formed image patches are securely supplied to cleaner 55.

The patch forming operation is performed under the control of controller 90 during the image formation (in performing a print operation). Controller 90 executes control program 91 to control the patch forming operation.

Figure 3:
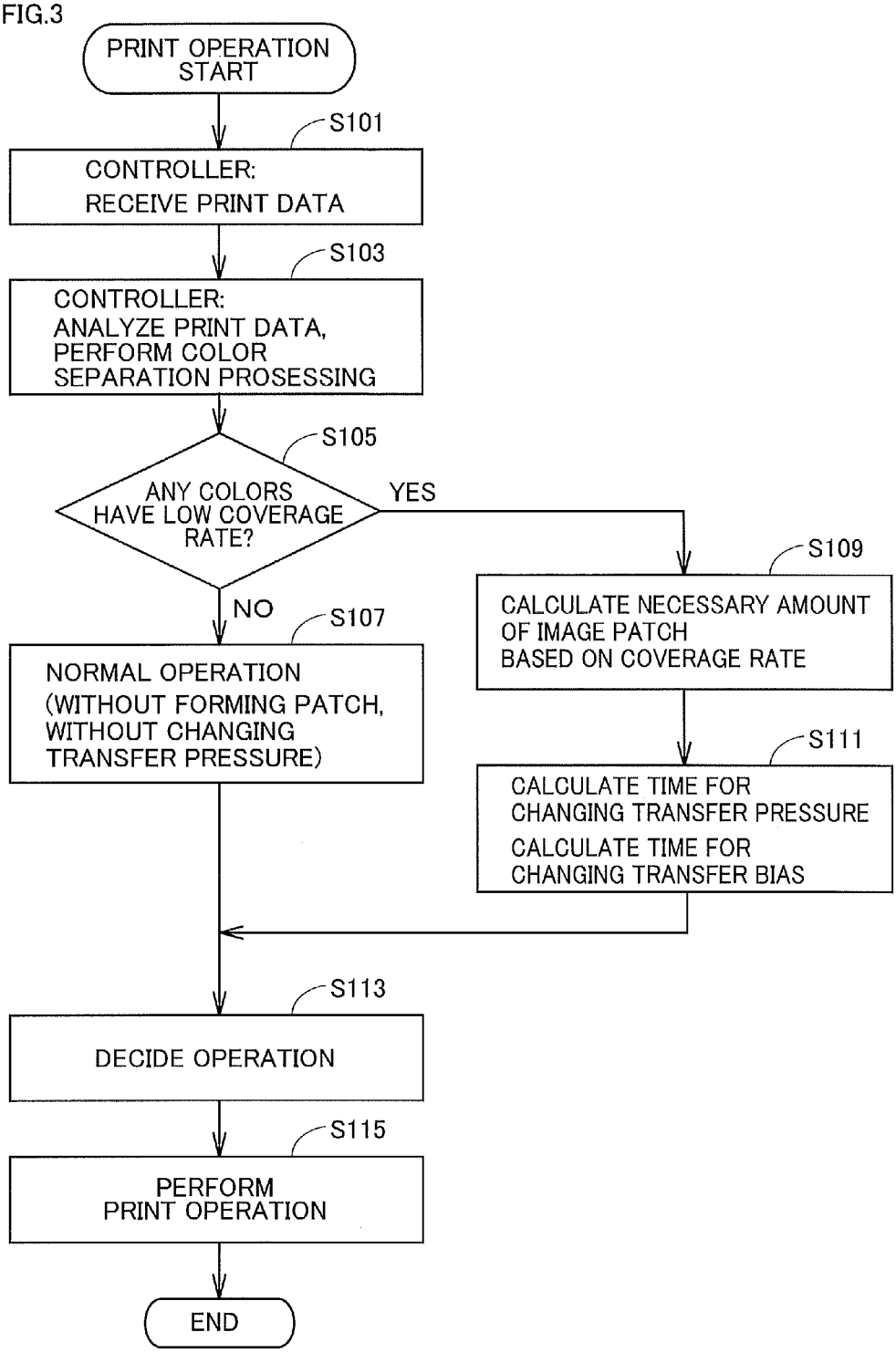
FIG. 3 is a flowchart illustrating a control content relating to a patch forming operation during image formation.

FIG. 3 is a flowchart illustrating a control content relating to the patch forming operation during the image formation.

The following operation is performed when the print is performed to each page (each sheet). As illustrated in FIG. 3, when the print operation is started, controller 90 receives print data in Step S101. For example, the print data is transmitted from an external personal computer and the like.

In Step S103, controller 90 analyzes the print data to perform color separation processing. Therefore, the image data is obtained in each of CMYK colors. Controller 90 analyzes the print pattern of the image in each color. That is, controller 90 calculates the coverage rate in each color.

In Step S105, controller 90 determines whether the calculated coverage rate is the color lower than a given threshold.

When the coverage rate is not the color lower than the given threshold in Step S105, controller 90 selects a normal print operation in Step S107. That is, controller 90 selects a control content such that the image forming operation is performed without forming the image patch in the inter-sheet domain and without changing settings, such as the transfer pressure.

On the other hand, when the coverage rate is the color lower than the given threshold in Step S105, pieces of processing in Steps S109 and S111 are performed. Controller 90 forms the image patch of the color in the inter-sheet domain, and selects the control content such that the settings, such as the transfer pressure, are changed at given timing to perform the image forming operation.

That is, in Step S109, the adjuster 92 in the calculates a necessary amount of image patch to be formed based on the calculated coverage rate. As described later, the adjuster 92 adjusts the control content so as to increase the formed image patch amount when the coverage rate is low, and the controller 90 selects the adjusted control content.

In Step S111, controller 90 calculates the time the transfer pressure is changed or the time the transfer bias is changed. The adjuster 92 adjusts the control content so as to decrease the transfer pressure and the transfer bias when the coverage rate is low, and the controller 90 selects the adjusted control content.

When the control content is selected in Step S107 or S111, controller 90 decides on the operation, which is performed by image forming apparatus 1, based on the selected control content in Step S113. That is, when the coverage rate is not the color lower than the given threshold in Step S105, controller 90 decides on the normal print operation. On the other hand, when the coverage rate is the color lower than the given threshold, based on the values calculated in Steps S109 and S111, controller 90 decides on the performance of the print operation associated with the operations, such as the formation of the image patch and the changes of the transfer pressure and the transfer bias, with respect to at least the color.

In Step S115, controller 90 performs the control such that the decided operation is performed, and performs the print operation. When the print is ended, the processing is ended with respect to the page.

Alternatively, processing of determining whether the coverage rate is lower than a given value may be made in each color in Step S105, and the processing in Step S107 or the pieces of processing in Steps S109 and S111 may be performed in each color.

[Description of Patch Forming Operation for Single Color]

Figure 4:
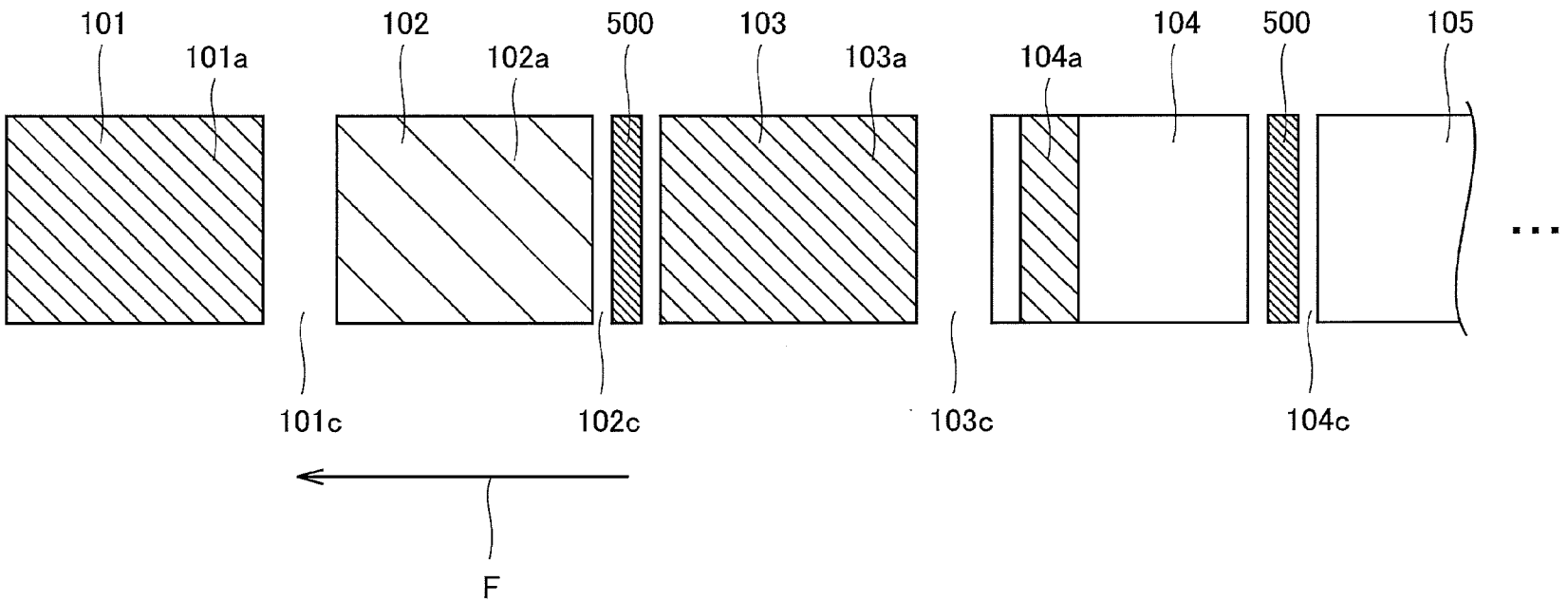
FIG. 4 is a view illustrating an example of an image forming operation accompanied with the patch forming operation.

FIG. 4 is a view illustrating an example of the image forming operation accompanied with the patch forming operation.

The plurality of colors are not distinguished from one another in the description made with reference to FIG. 4. In other words, the operation and the control, which are performed to one printhead 31, are described below.

It is assumed that image forming apparatus 1 continuously forms the images on the plurality of sheets, namely, the print is performed to a plurality of pages. As illustrated in FIG. 4, an image 101*a* is printed on a first page 101. An image 102*a* is printed on a second page 102. An image 103*a* is printed on a third page 103. An image 104*a* is printed on a part of a fourth page 104. In FIG. 4, an arrow F indicates a sheet conveying direction (a direction in which the latest print is performed on the sheet). FIG. 4 is a view illustrating the toner images, which are formed on photosensitive body 51 in performing the print to the plurality of pages, while the toner images arc developed along the sheet conveying direction.

In the example in FIG. 4, images 101*a* and 103*a* have the coverage rate so high that it is not necessary to form the image patch. Specifically, for example, a document image including the characters in a wide range of one page or an image including the solid image/photograph having a certain degree of density in a certain degree of area corresponds to images 101*a* and 103*a*. On the other hand, although image 102*a* is formed in a wide range of one page, image 102*a* has the coverage rate so low that it is necessary to form the image patch. Specifically, for example, a document image partially including the characters in the whole image of one page or an image having the low density even in a wide area of print domain corresponds to image 102*a*. Image 104*a* is formed in a narrow range of one page, and image 104*a* has the coverage rate so low that it is necessary to form the image patch. Specifically, for example, an image, which has the low coverage rate of one page because the print domain has the high density in a small area of print domain, corresponds to image 104*a*. For example, a document image, which includes the characters only in a part of one page because a page break is performed on the way, also corresponds to image 104*a*.

When the plurality of pages 101, 102, . . . are printed, as described above, controller 90 calculates the coverage rate with respect to each of pages 101, 102, . . . , and performs the image patch forming operation according to the coverage rate.

Controller 90 determines that the coverage rate is not low for first page 101. Therefore, the image patch is not formed in the subsequent inter-sheet domain, namely, an inter-sheet domain 101*c* between first page 101 and second page 102. In other words, because the coverage rate is not low, the adjuster 92 performs the adjustment such that the image patch is not formed.

As described above, controller 90 determines that the coverage rate is low for second page 102. Therefore, an image patch 500 is formed in an inter-sheet domain 102*c* between second page 102 and third page 103. In other words, because the coverage rate is low, the adjuster 92 performs the adjustment such that image patch 500 is formed. As described later, an amount of formed image patch 500 is adjusted according to the coverage rate.

Controller 90 determines that the coverage rate is not low for third page 103. Therefore, as with first page 101, the image patch is not formed in an inter-sheet domain 103*c* between third page 102 and fourth page 103.

As described above, controller 90 determines that the coverage rate is low for fourth page 104. Therefore, as with second page 102, image patch 500 is formed in an inter-sheet domain 104*c* between fourth page 104 and a fifth page 105.

When image patch 500 is formed for second page 102 and fourth page 104 as described above, controller 90 changes the transfer pressure and the transfer bias from those of the normal print operation in inter-sheet domains 102*c* and 104*c*. That is, in each of inter-sheet domains 102*c* and 104*c*, the transfer pressure is changed to zero or a value smaller than that of the normal image formation (such that pressuring and contacting force is weakened), and the transfer bias is set to zero. Therefore, in inter-sheet domain 102*c* and 104*c*, primary transfer roller 33 and intermediate transfer belt 41 are separated from each other, or the pressuring and contacting force of intermediate transfer belt 41 to photosensitive body 51 is weakened. That is, a contact state between photosensitive body 51 and intermediate transfer belt 41 changes. The toner on photosensitive body 51 hardly moves to intermediate transfer belt 41 by setting the transfer bias to zero. Accordingly, the amount of toner supplied to the cleaning blade is adjusted by the above control.

[Description of Adjustment of Image Patch Amount According to Coverage Rate]

In the embodiment, for example, controller 90 calculates the necessary amount of image patch to be formed based on the coverage rate of the image in the following way.

Specifically, first, controller 90 calculates the amount (first toner amount) of toner, which reaches cleaning blade 55*a* by forming the image, based on the coverage rate of the image. For example, the first toner amount is obtained by multiplying the amount of toner used to print the image, namely, the amount of toner used to form the toner image on photosensitive body 51 by a given residual coefficient.

Second, controller 90 acquires the amount (second toner amount) of toner necessary to be supplied to cleaner 55. For example, a previously-set given value can be used as the second toner amount.

Third, controller 90 calculates the amount of toner necessary to form the image patch on photosensitive body 51 (necessary toner amount) using the second toner amount and the first toner amount. The amount (third toner amount) of toner, which reaches cleaning blade 55*a* by forming the image patch, is first calculated. Then the necessary toner amount is obtained by comparing a value, in which the first toner amount and the third toner amount are added, to the second toner amount. That is, the third toner amount is decided on such that the value, in which the first toner amount and the third toner amount are added, is equal to the second toner amount.

Here, in the embodiment, because the transfer pressure and the transfer bias are adjusted in forming the image patch, the substantially whole toner which is the formed image patch is supplied to cleaner 55. That is, the necessary toner amount directly becomes the third toner amount. Accordingly, a value in which the first toner amount is subtracted from the second toner amount is directly calculated as the necessary toner amount. When the transfer pressure and the transfer bias are not adjusted, the necessary toner amount is increased more than the third toner amount by the amount of toner moving to intermediate transfer belt 41 in the image patch.

When the necessary toner amount is calculated in the above manner, the amount of image patch to be formed can be calculated based on the necessary toner amount. Controller 90 can form the image patch using the necessary toner amount by properly setting the area and density of the image patch. For example, when the image patches having the same density are formed, the image patch having the larger area is formed with decreasing coverage rate of the image formed on the sheet. On the other hand, when the image patches having the same area are formed, the image patch having the higher density is formed with decreasing coverage rate of the image formed on the sheet.

Figure 5:
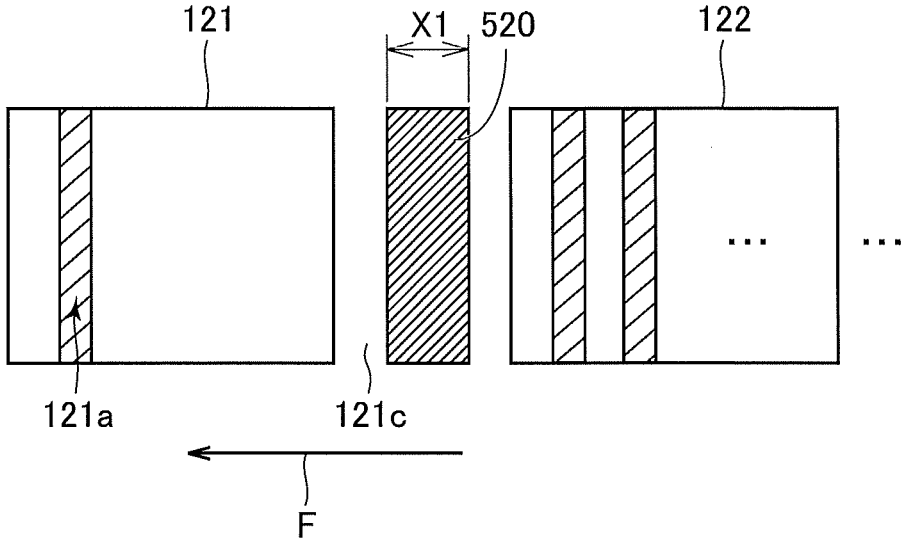
FIGS. 5 to 8 are views illustrating an adjustment of an image patch amount.

FIG. 5 is a first view illustrating the adjustment of the image patch amount.

Referring to FIG. 5, it is assumed that a first page 121 in which an image 121*a* is printed and a second page 122 subsequent to first page 121 are successive in the image forming operation. In FIG. 5, arrow F indicates the sheet conveying direction.

The print domain of image 121*a* is provided only in a restricted domain of first page 121, and image 121*a* has the considerably low coverage rate. Therefore, an image patch 520 is formed in an inter-sheet domain 121*c* between first page 121 and second page 122. X1 is a width (a length in the sheet conveying direction (the length orthogonal to the main scanning direction)) of image patch 520, and width X1 is formed relatively longer.

Figure 6:
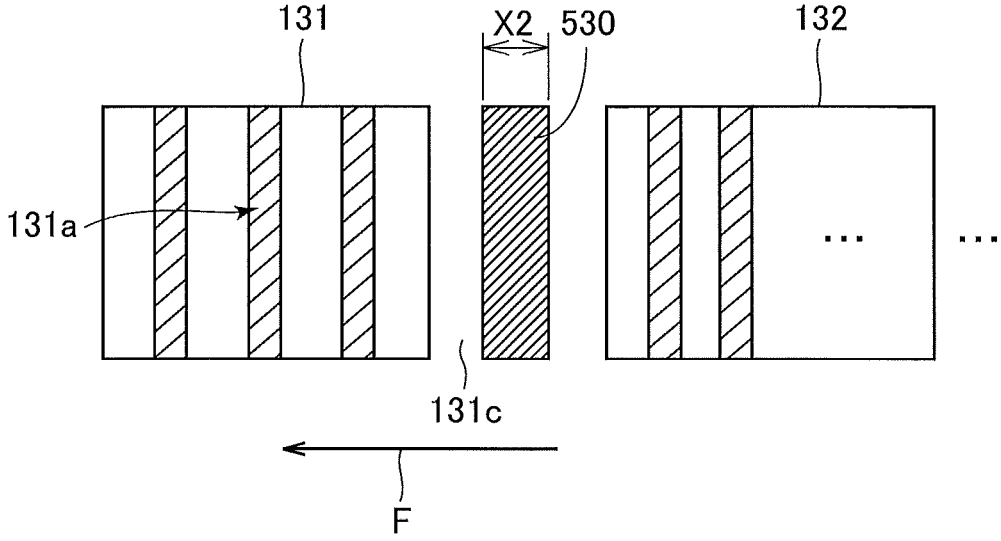

FIG. 6 is a second view illustrating the adjustment of the image patch amount.

Referring to FIG. 6, it is assumed that a first page 131 in which an image 131*a* is printed and a second page 132 subsequent to first page 131 are successive in the image forming operation. In FIG. 6, arrow F indicates the sheet conveying direction.

Image 131*a* has the low coverage rate. The coverage rate of image 131*a* is higher than that of image 121*a*. An image patch 530 is formed in an inter-sheet domain 131*c* between first page 131 and second page 132. A width X2 of image patch 530 is lower than width X1. That is, the coverage rate of image 131*a* is higher than that of image 121*a*, and therefore image patch 530 in which the area is smaller than that of image patch 520 is formed.

Figure 7:
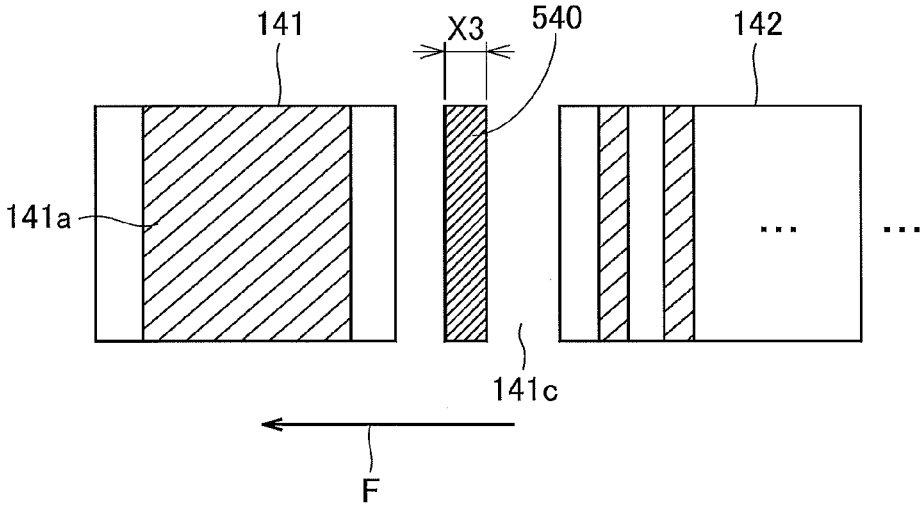

FIG. 7 is a third view illustrating the adjustment of the image patch amount.

Referring to FIG. 7, it is assumed that a first page 141 in which an image 141*a* is printed and a second page 142 subsequent to first page 141 are successive in the image forming operation. In FIG. 7, arrow F indicates the sheet conveying direction.

The coverage rate of image 141*a* is slightly lower than a given coverage rate at which it is not necessary to form the image patch. That is, the coverage rate of image 141*a* is higher than that of image 131*a*. An image patch 540 is formed in an inter-sheet domain 141*c* between first page 141 and second page 142. A width X3 of image patch 540 is lower than width X2. That is, the coverage rate of image 141*a* is higher than that of image 131*a*, and therefore image patch 540 in which the area is smaller than that of image patch 530 is formed.

At this point, when the image patch is formed, the area of the image patch is equalized irrespective of the coverage rate, and the density of the image patch may be adjusted according to the coverage rate. In this case, for example, the image patch may be formed as follows.

Figure 8:
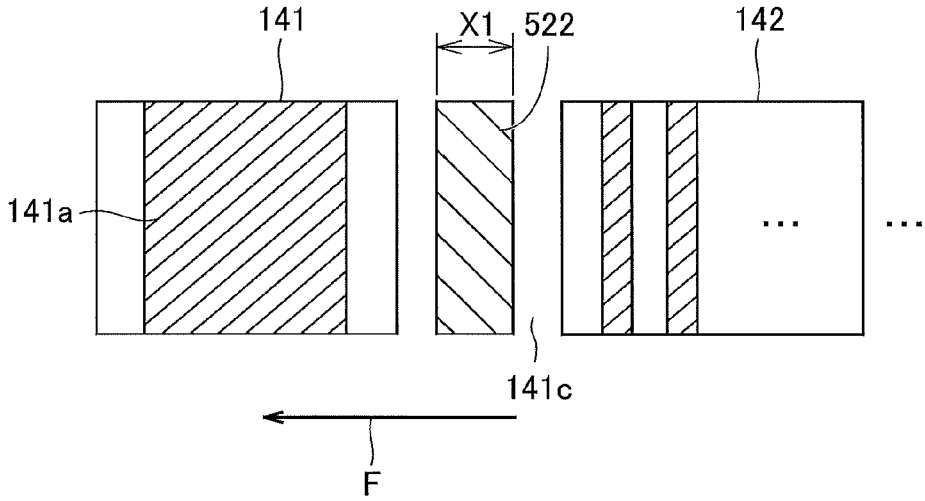

FIG. 8 is a fourth view illustrating the adjustment of the image patch amount.

Referring to FIG. 8, it is assumed that an image patch 522 having the same area as image patch 520 is formed when first page 141 and second page 142 are successive as with the third view in FIG. 7. That is, image patch 522 has the same width X1 as image patch 520. The coverage rate of image 141*a* is higher than that of image 121*a*, and therefore the density of image patch 522 is adjusted lower than that of image patch 520. At this point, the density of image patch 522 is adjusted such image patch 522 is formed using the same toner amount as image patch 540 having the relatively small area.

[Description of Patch Forming Operation for Plural Colors]

In the patch forming operation, when the image patch is formed, the image patch amount is controlled such that an amount of image patch color is increased toward the color on the upstream side in the rotating direction of intermediate transfer belt 41 in the CMYK colors. That is, when the image patch is formed in each color, the image patch amount is the largest for the yellow (Y), and the image patch amount is decreased in the descending order of magenta (M), cyan (C), and black (B).

The reason that the area of the magenta image patch is smaller than that of the yellow image patch is as follows. At this point, it is assumed that the transfer pressure and the transfer bias are not changed when the image patch is formed. In this case, for the magenta, the toner is supplied to magenta photosensitive body 51 from the yellow side by a reverse transfer through intermediate transfer belt 41. As used herein, the reverse transfer means that the toner remaining on intermediate transfer belt 41 moves from intermediate transfer belt 41 to photosensitive body 51 that contacts with intermediate transfer belt 41. Because the toner for the reverse transfer is also sent to cleaner 55, the size of the image patch can be reduced for the magenta. Similarly, for the cyan on the downstream side of the magenta, the area of the image patch can further be reduced because the yellow toner and the magenta toner are supplied by the reverse transfer. For the black on the downstream side of the cyan, the area of the image patch can further be reduced because the yellow toner, the magenta toner, and the cyan toner are supplied by the reverse transfer.

The transfer pressure and the transfer bias may be changed when the image patch is formed. The reverse transfer is generated as long as photosensitive body 51 and intermediate transfer belt 41 contact with each other. However, when the transfer pressure and the transfer bias are changed while the image patch is formed, the amount of toner moving from photosensitive body 51 onto intermediate transfer belt 41 is decreased to decrease the amount of reversely-transferred toner (reverse transfer amount). Accordingly, in this case, the amount of image patch formed on the downstream side may be adjusted according to the decreased reverse transfer amount.

Figure 9:
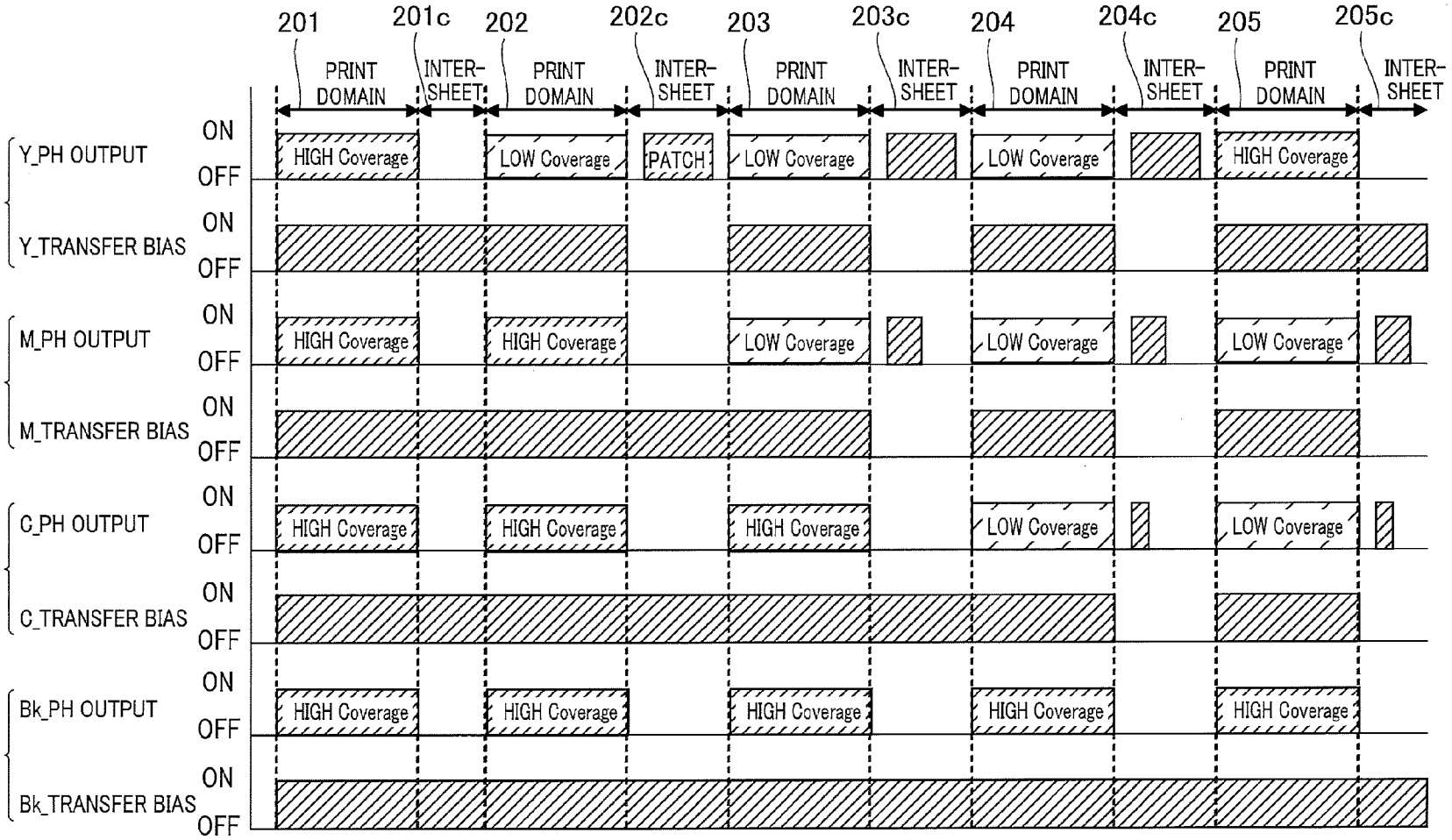
FIG. 9 is a view illustrating an example of the image forming operation accompanied with the patch forming operation.

FIG. 9 is a view illustrating an example of the image forming operation accompanied with the patch forming operation.

FIG. 9 illustrates the case that the plurality of pages including a first page 201 to a fifth page 205 are printed, and the operation in which the coverage rates of the CMYK colors are different from one another with respect to each of pages 201 to 205. In FIG. 9, a horizontal axis indicates positions of the print domain and the domain corresponding to the inter-sheet domain from first page 201 on photosensitive body 51 of each color. A vertical axis indicates the existence or non-existence (on/off of PH output) of the toner image formed on photosensitive body 51 and on/off of the transfer bias with respect to each of the yellow (Y), magenta (M), cyan (C), and black (B(Bk)) in order from above stage.

As illustrated in FIG. 9, in first page 201, the coverage rate is high for each color (high coverage). Accordingly, the image patch is not formed in a subsequent inter-sheet domain 201*c*. At this point, in inter-sheet domain 201*c*, the transfer bias remains applied to primary transfer roller 33 of each color (remains in the on state).

In second page 202, the coverage rate is low only for the yellow (low coverage), and the coverage rate is high for other colors. In this case, in an inter-sheet domain 202*c*, the image patch is formed on photosensitive body 51 only for the yellow. Moreover in this case, in inter-sheet domain 202*c*, the application of the transfer bias is released only for the yellow (becomes the off state). The transfer bias remains applied to primary transfer rollers 33 of other colors.

In third page 203, the coverage rate is low only for the yellow and the magenta. In this case, in an inter-sheet domain 203*c*, the image patch is formed and the application of the transfer bias is released only for the yellow and the magenta. As described above, the area of the image patch formed for the magenta is smaller than that of the image patch formed for the yellow.

In fourth page 204, the coverage rate is low for the yellow, the magenta, and the cyan. Therefore, in an inter-sheet domain 204*c*, the image patch is formed and the application of the transfer bias is released only for the yellow, the magenta, and the cyan. As with third page 203, the area of the image patch formed for the magenta is smaller than that of the image patch formed for the yellow. The area of the image patch formed for the cyan is further smaller than that of the image patch formed for the magenta.

In fifth page 205, the coverage rate is low only for the magenta and the cyan. In this case, in an inter-sheet domain 205*c*, the image patch is formed and the application of the transfer bias is released only for the magenta and the cyan. Because the coverage rate is high for the yellow and the black, the image patch is not formed in an inter-sheet domain 205*e*, and the transfer bias remains applied to primary transfer roller 33. At this point, although the image patch is not formed for the yellow, the yellow toner is supplied as the toner for the reverse transfer to the downstream-side magenta and cyan. Because the yellow toner for the reverse transfer exists, the areas of the image patches formed for the magenta and the cyan have the same areas of those of fourth page 204.

The above operation is schematically described by way of example, and the amount of image patch of each color is adjusted according to the coverage rate of the color. For the image having the low coverage rate, the total amount of toner supplied to cleaner 55 is adjusted such that the toner amount of each color becomes even.

In addition to the adjustment of the image patch formed according to the coverage rate of a certain color, the adjuster 92 may adjust the formed image patch according to the coverage rate of the upstream color of that color. In other words, the adjuster 92 may adjust the image patch formed on photosensitive body 51 of each color, and adjust the image patch of the downstream-side color based on the adjustment result of the image patch for the color on the upstream side in the rotating direction of intermediate transfer belt 41.

For example, the image patch is formed for the magenta, the adjuster 92 may adjust the area of the image patch and the like based on whether the image patch is formed for the yellow which is the upstream color of the magenta. In this case, for example, when the image patch is formed for the yellow, the adjustment may be performed such that the area of the image patch formed for the magenta is reduced compared with the case that the image patch is not formed for the yellow. The control may be performed by comparing the case that the image patch is formed by the upstream color to the case that the image patch is not formed by the upstream color with respect to the amount of upstream-side toner supplied to photosensitive body 51 by the reverse transfer through intermediate transfer belt 41. In this case, the control may be performed such that the amount of toner including the toner for the reverse transfer is properly sent to cleaner 55 according to the comparison result.

Effect of Embodiment

As described above, in the embodiment, whether the image patch is formed in the inter-sheet domain depends on the coverage rate of the image formed on the sheet when the patch forming operation is performed. Accordingly, the toner is always stably supplied to cleaner 55, and the state in which photosensitive body 51 can properly be cleaned is always maintained by cleaner 55, so that the state in which the image can properly be formed can be maintained. The image patch is not formed when the image, which has the coverage rate so high that it is not necessary to form the image patch is printed, so that toner consumption can be suppressed.

Controller 90 performs the control such that the amount of image patch to be formed is increased with decreasing coverage rate. Accordingly, in cleaner 55, the amount of toner supplied to cleaning blade 55*a* is increased more than a given amount to perform the stable operation. Because the image patch is formed using the necessary amount of toner at that time, the excess toner is not consumed, and running cost of image forming apparatus 1 can be reduced.

When the image patch is formed, the transfer pressure and the transfer bias of the primary transfer roller 33 are changed in the inter-sheet domain. Because the image patch, which is formed to supply the image patch to cleaner 55, can directly be supplied to cleaner 55, it is not necessary to increase the image patch amount. Accordingly, the effect to further suppress the toner consumption can be obtained.

The image patch amount is controlled so as to increase toward the upstream side in the rotating direction of intermediate transfer belt 41 of each of the CMYK colors. Accordingly, the toner consumption amount associated with the patch forming operation can be reduced for the downstream-side color of intermediate transfer belt 41, and the running cost of image forming apparatus 1 can further be reduced.

[Description of Modifications]

Instead of the coverage rate or together with the coverage rate, controller 90 may analyze a bias of the toner density in the main scanning direction as the print pattern of the image. For example, controller 90 may analyze the coverage rate for each of a plurality of domains into which the image formed on the sheet is divided in the main scanning direction, and adjust the image patch according to its analysis result.

Figure 10:
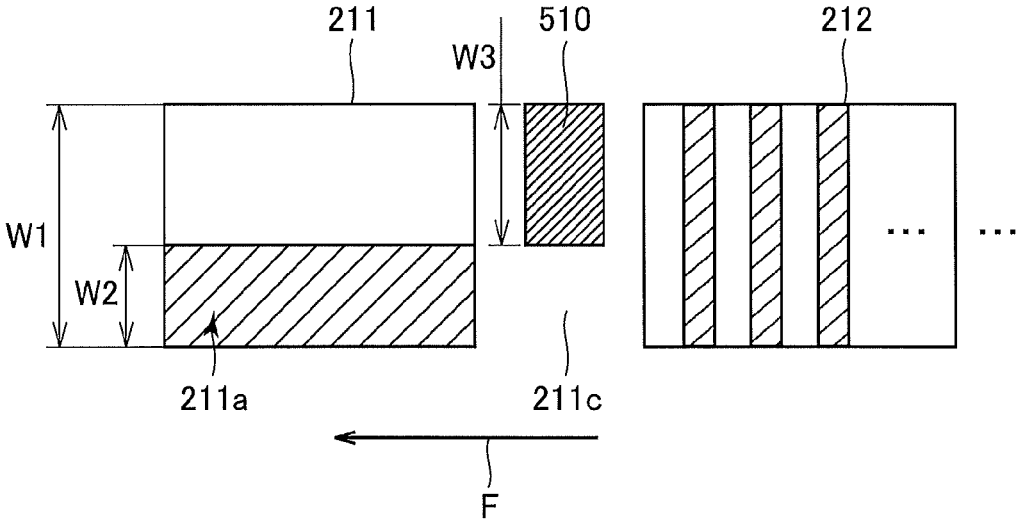
FIG. 10 is a view illustrating an example of the patch forming operation performed by an image forming apparatus according to a modification of the embodiment.

FIG. 10 is a view illustrating an example of the patch forming operation performed by an image forming apparatus according to a modification of the embodiment.

Referring to 10, it is assumed that a first page 211 in which an image 211*a* is printed and a second page 212 subsequent to first page 211 are successive in the image forming operation. In FIG. 10, arrow F indicates the sheet conveying direction.

Image 211*a* includes the print domain only in the restricted domain of first page 211. In first page 211, the print domain of image 211*a* is disposed on the left with respect to the sheet conveying direction. That is, in first page 211, the print domain of image 211*a* is disposed while biased on one side in the main scanning direction (a vertical direction in FIG. 10). Therefore, in the image 211*a*, the toner density is biased in the main scanning direction. Assuming that W1 is a size in the main scanning direction of first page 211, the print domain of image 211*a* is formed in a part of first page 211 so as to obtain a size W2 in the main scanning direction. In other words, the coverage rate of image 211*a* varies in each of the two domains into which image 211*a* is divided in the main scanning direction.

In this case, in an inter-sheet domain 211*c* between first page 211 and second page 212, the image patch is formed according to the coverage rate of the domain in a portion corresponding to each of the domains into which image 211*a* is divided. In other words, an image patch 510 is formed in inter-sheet domain 211*c* according to the bias of the toner density in the main scanning direction of image 211*a*. That is, in inter-sheet domain 211*c*, image patch 510 is formed in a portion (a range indicated by a size W3 in FIG. 10) except a range where the print domain of image 211*a* is formed in the main scanning direction.

Figure 11:
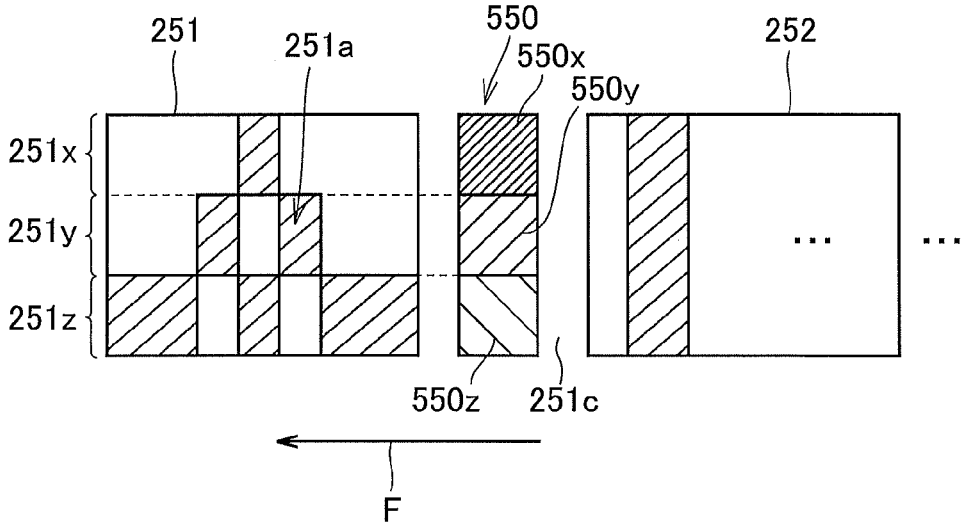
FIG. 11 is a view illustrating another example of the patch forming operation performed by an image forming apparatus according to a modification of the embodiment.

FIG. 11 is a view illustrating another example of the patch forming operation performed by an image forming apparatus according to a modification of the embodiment.

Referring to FIG. 11, it is assumed that a first page 251 in which an image 251*a* is printed and a second page 252 subsequent to first page 251 are successive in the image forming operation. In FIG. 11, arrow F indicates the sheet conveying direction.

In first page 251, image 251*a* has the bias of the toner density in the main scanning direction. As illustrated in FIG. 11, the coverage rate of image 251*a* varies in each of three domains 251*x*, 251*y*, and 251*z* into which first page 251 is substantially equally divided in the main scanning direction. Specifically, domain 251*x* on the right with respect to a sheet proceeding direction has the lowest coverage rate, domain 251*y* in a central portion of the sheet has the second lowest coverage rate, and domain 251*z* on the left with respect to a sheet proceeding direction has the highest coverage rate.

In this case, an image patch 550 is formed in an inter-sheet domain 251*c* between first page 251 and second page 252. Image patch 550 has domains 550*x*, 550*y*, and 550*z*, in which the toner amounts used differ from one another, so as to correspond to domains 251*x*, 251*y*, and 251*z* of image 251*a*. Specifically, for domain 550*x* that corresponds to the position of domain 251*x* in the main scanning direction, for example, the density is adjusted relatively high such that the image patch amount is increased according to the coverage rate of domain 550*x*. For domain 550*y* corresponding to domain 251*y*, the density is adjusted lower than that of domain 550*x* according to the coverage rate of domain 550*y*. For domain 550*z* corresponding to domain 251*z*, the density is adjusted such that the image patch amount becomes relatively small according to the coverage rate of domain 550*z*, for example, such that the density is lower than that of domain 550*x* and 550*y*.

Thus, when the bias of the toner density in the main scanning direction exists in the image formed on the sheet, the image patches 510 and 550 are formed according to the bias of the toner density. Accordingly, the image patch is formed only in the necessary portion in the main scanning direction, and the toner consumption amount can be reduced.

One of the transfer pressure and the transfer bias of primary transfer roller 33 may be changed while the other is not changed.

FIG. 12 is a table illustrating an evaluation result of the operation of the image forming apparatus of the embodiment.

FIG. 12 illustrates results of evaluations of the existence or non-existence of an image noise and the increase or decrease of the toner consumption amount when image forming apparatus 1 was operated to perform 100 k prints under four conditions including Examples 1 to 3 and Reference Example 4. The evaluations were performed at a temperature of 23 degrees Celsius and humidity of 65%.

The evaluation were performed with respect to Examples 1 to 3 and Reference Example 4 under a condition (image determination and variable patch amount) whether the image patch is adjusted (YES) or not (the image patch is always formed (NO)), a condition (variable primary transfer bias) whether the transfer bias is changed (YES) or not (the transfer bias is always applied (NO)), and a condition (variable primary transfer pressure) whether the transfer pressure is changed (YES) or not (NO). The condition is set such that pressuring and contacting force becomes a half of that of the image formation when the transfer pressure is changed from the usual state (YES), and such that the pressuring and contacting force becomes equal to that of the image formation when the transfer pressure is not changed (NO). The evaluations were performed by observing the generation of the image noise, namely, a frequency of the noise generation is extremely small (VERY GOOD), the frequency of the noise generation is relatively small (GOOD), the noise generation is slightly observed (AVERAGE), and the noise is markedly generated. The toner consumption amount is determined based on whether the toner consumption amount is smaller than that of the usual state (GOOD) or larger than that of the usual state (BAD).

As illustrated in FIG. 12, the image patch is adjusted in Examples 1 to 3. The transfer bias and the transfer pressure are changed in Example 1, the transfer pressure is not changed in Example 2, and the transfer bias is not changed in Example 3. In Examples 1 to 3, the toner consumption amount is decreased, and the effect to suppress the toner consumption is obtained. As to the image noise, the best result is obtained in Example 1 in which the transfer bias and the transfer pressure are changed, and relatively better result is obtained in Examples 2 and 3. Accordingly, in Examples 1 to 3, the toner consumption amount is reduced, and the image can properly be formed.

On the other hand, in Reference Example 4, the image patch is not adjusted, but the image patch is always formed irrespective of the coverage rate of the image. The transfer bias and the transfer pressure are also changed. Therefore, as to the image noise, the best result is obtained similarly to Example 1. However, because the image patch is always formed, the toner consumption amount increases.

Both the transfer pressure and the transfer bias of primary transfer roller 33 may not be changed. The effect that the toner consumption amount is reduced while the image is properly formed can be obtained such that the image patch is formed according to the print pattern of the image.

[Others]

Instead of the coverage rate or the bias of the toner density in the main scanning direction, or together with the coverage rate or the bias of the toner density in the main scanning direction, controller may analyze an attribute of the image as the print pattern of the image. Examples of the attribute of the image include a document image, a photograph image, and an image having a solid (filled) domain.

For example, the toner supplied to the cleaner is relatively increased when the image includes the solid domain, or when the image is the photograph image. Accordingly, when the attribute of the image is analyzed as the photograph image or the image including the solid domain, the adjustment can be performed such that the image patch is not formed or such that the image patch amount is decreased. On the other hand, when the image is the document image, frequently the toner supplied to the cleaner is relatively decreased. Accordingly, when the attribute of the image is analyzed as the document image, the adjustment can be performed such that the image patch is formed according to the document image.

By the image patch adjusted based on the attribute of the image, similarly the toner consumption amount caused by the formation of the extra image patch is reduced to maintain the state in which the cleaning of the photosensitive body is properly performed.

The controller may change only the determination whether the image patch is formed according to the coverage rate of the image. That is, the controller may not adjust the image patch amount when the image patch is formed. Even in this case, the amount of toner supplied to the cleaner is maintained by the formation of the image patch according to the coverage rate of the image, and the state in which the image is properly formed can be maintained.

The image forming apparatus is not one that can form the color image, but one that can form a monochrome image using, for example, a single-color printhead of black. In the image forming apparatus that can form the monochrome image, the intermediate transfer belt is not provided, but the toner image is directly transferred to the sheet from the photosensitive body by a transfer roller that nips the sheet together with the photosensitive body. That is, the transfer pressure and the transfer bias of the transfer roller are changed according to the existence or non-existence of the formation of the image patch. Even in this case, the print pattern, such as the coverage rate of the image is analyzed to adjust the image patch according to the analysis result, which allows the same effect to be obtained.

The image forming apparatus may be not the tandem type in which the printheads of the plurality of colors are arrayed along the intermediate transfer belt, but a rotary type in which the image is formed while the printheads of the plurality of colors are rotated and switched. Even in this case, the image patch is adjusted according to the print pattern of the image, which allows the same effect to be obtained.

The image forming apparatus may be any of a black-and-white or color copier, printer, facsimile machine, or a multi-function peripheral (MFP) as a combination thereof. The image forming apparatus may be an MFP (Multi Function Peripheral) including a scanner function, a copying function, a function as a printer, a facsimile function, a data communication function, and a server function. As used herein, the scanner function means a function of reading the image of the set document and storing the image in an HDD (Hard Disk Drive) and the like. The copying function is a function of printing the image on the sheet. The function as the printer is a function of performing, when a print instruction is received from an external device, such as a PC, the print to the sheet based on the print instruction. The facsimile function is a function of receiving facsimile data from an external facsimile device and the like and storing the facsimile data in the HDD. The data communication function is a function of transmitting and receiving data to and from the connected external device. The server function is a function of sharing the data stored in the HDD by a plurality of users.

The processes according to the above embodiments may be performed by software or by using a hardware circuit.

A program for executing the processes according to the above embodiments may be provided as well. The program may be recorded on a recording medium, such as a CD-ROM, flexible disk, hard disk, ROM, RAM, memory card, or the like, so as to be provided to the user. The program may also be downloaded to the device via a communication line such as the Internet. The processes described in conjunction with the flowcharts above are executed by a CPU and the like in accordance with the program.

According to the embodiment, the image patch formed in the domain corresponding to the inter-sheet portion between the sheet and the next sheet on the image bearing body is adjusted according to the analysis result of the print pattern of the image formed on the sheet. Accordingly, the image forming apparatus, in which the toner consumption amount is decreased and the chatter or peeling of the cleaning blade is prevented to maintain the state in which the image is properly formed, can be provided.

It should be understood that the embodiments described above are illustrative and non-restrictive in every respect. The scope of the present invention is defined by the terms of the claims, rather than the description above, and is intended to include any modifications within the scope and meaning equivalent to the terms of the claims.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus that forms an image on a sheet by an electrophotographic system, the image forming apparatus comprising:

an image bearing body for rotating in a given direction;

a latent image forming section for forming a latent image on said image bearing body;

a development section for developing said latent image using toner to form a toner image on said image bearing body;

a transfer section for transferring said toner image to a transferred body;

a pressuring and contacting section for pressuring and contacting said transfer section against and with said image bearing body via said transferred body;

a cleaning blade contacting with said image bearing body, the cleaning blade being disposed to remove residual toner remaining on said image bearing body after said toner image is transferred to said transferred body by said transfer section; and a controller for controlling each section of said image forming apparatus, wherein said controller includes an analyzer for analyzing a print pattern of the image to be formed on the sheet, and an adjuster for controlling said pressuring and contacting section to change a contact state between said image bearing body and said transferred body while adjusting an image patch formed in a domain corresponding to an inter-sheet portion between the sheet and the next sheet on said image bearing body according to an analysis result of said analyzer.

2. The image forming apparatus according to claim 1, wherein said transfer section is applied a transfer voltage to transfer said toner image from said image bearing body to said transferred body, said controller controls said transfer voltage according to the analysis result of said analyzer.

3. The image forming apparatus according to claim 1, wherein said transferred body is an intermediate transfer belt, said image forming apparatus includes a plurality of sets of said image bearing body, said latent image forming section, said development section, said transfer section, said pressuring and contacting section, and said cleaning blade, which are disposed along said intermediate transfer belt to form a plurality of color images, said adjuster adjusts said image patch formed on each of said plurality of image bearing bodies, wherein the adjustment of a downstream-side of the image bearing body in a rotating direction of said intermediate transfer belt is performed based on an adjustment result of an upstream-side of the image bearing body.

4. The image forming apparatus according to claim 1, wherein said print pattern includes at least one of a coverage rate, an attribute, and a bias of toner density in a main scanning direction of the image.

5. The image forming apparatus according to claim 1, wherein said analyzer analyzes at least a coverage rate of the image to be formed on the sheet, said controller further includes a first calculator for calculating an amount of toner, which reaches said cleaning blade after said toner image is transferred from said image bearing body to said transferred body, based on the coverage rate analyzed by said analyzer, a second calculator for calculating an amount of toner, which reaches said cleaning blade by the formation of said image patch, and a comparison section for comparing a given value to a value in which a value calculated by said first calculator and a value calculated by said second calculator are added, and said adjuster adjusts said image patch to be formed based on a comparison result of said comparison section.

6. The image forming apparatus according to claim 1, wherein said analyzer performs said analysis to a plurality of domains into which the image to be formed on the sheet is divided in a main scanning direction, and said adjuster adjusts said image patch to each of said plurality of domains.

7. The image forming apparatus according to claim 1, wherein the adjustment of said image patch by said adjuster includes a change of at least one of density and an area of said image patch.

8. A method for controlling an image forming apparatus that forms an image on a sheet by an electrophotographic system, said image forming apparatus including:

an image bearing body for rotating in a given direction;

a latent image forming section for forming a latent image on said image bearing body;

a development section for developing said latent image using toner to form a toner image on said image bearing body;

a transfer section for transferring said toner image to a transferred body;

a pressuring and contacting section for pressuring and contacting said transfer section against and with said image bearing body via said transferred body; and a cleaning blade contacting with said image bearing body, the cleaning blade being disposed to remove residual toner remaining on said image bearing body after said toner image is transferred to said transferred body by said transfer section, the image forming apparatus controlling method comprising:

analyzing a print pattern of the image to be formed on the sheet; and controlling said pressuring and contacting section to change a contact state between said image bearing body and said transferred body, and adjusting an image patch formed in a domain corresponding to an inter-sheet portion between the sheet and the next sheet on said image bearing body according to an analysis result in said analyzing.

9. A non-transitory computer-readable recording medium for controlling an image forming apparatus that forms an image on a sheet by an electrophotographic system, the computer-readable recording medium having a program causing a computer to execute processing, said image forming apparatus including:

an image bearing body for rotating in a given direction;

a latent image forming section for forming a latent image on said image bearing body;

a development section for developing said latent image using toner to form a toner image on said image bearing body;

a transfer section for transferring said toner image to a transferred body;

a pressuring and contacting section for pressuring and contacting said transfer section against and with said image bearing body via said transferred body; and a cleaning blade contacting with said image bearing body, the cleaning blade being disposed to remove residual toner remaining on said image bearing body after said toner image is transferred to said transferred body by said transfer section, said program causing a computer to execute processing comprising:

analyzing a print pattern of the image to be formed on the sheet; and controlling said pressuring and contacting section to change a contact state between said image bearing body and said transferred body, and adjusting an image patch formed in a domain corresponding to an inter-sheet portion between the sheet and the next sheet on said image bearing body according to an analysis result in said analyzing.

* * * * *